US005927221A

United States Patent [19]

Porter et al.

[11] Patent Number: 5,927,221

[45] Date of Patent: Jul. 27, 1999

[54] METHOD AND APPARATUS FOR JOIN AND SEW APPLICATION

[75] Inventors: Michael R. Porter, Topsfield, Mass.; Steven Marcangelo, Derry, N.H.; Frank W. Laroe, III, Topsfield, Mass.

[73] Assignee: Porter Sewing Machines, Inc., Beverly, Mass.

[21] Appl. No.: 08/714,152

[22] Filed: Dec. 17, 1996

Related U.S. Application Data

[63] Continuation-in-part of application No. 08/210,584, Mar. 17, 1994, Pat. No. 5,520,129.

[51] Int. Cl.[6] ..... D05B 21/00; D05B 65/02; D05B 69/08

[52] U.S. Cl. ..... 112/470.07; 112/221; 112/275; 112/300; 112/DIG. 3

[58] Field of Search ..... 112/470.07, 470.06, 112/2.1, 296, 297, 298, 300, 301, 275, 117, 119, 475.08, 475.21, DIG. 3, 221, 220

[56] References Cited

U.S. PATENT DOCUMENTS

| | | | |
|---|---|---|---|
| 1,620,249 | 3/1927 | Corrall et al. | 112/239 |
| 2,870,726 | 1/1959 | Matuzas | 112/237 X |
| 3,092,055 | 6/1963 | Hall | 112/221 |
| 3,245,369 | 4/1966 | Myska | 112/239 X |
| 3,403,648 | 10/1968 | Jarrett | 112/301 X |
| 4,073,250 | 2/1978 | Kasuga | 112/274 |
| 4,459,925 | 7/1984 | Miyachi et al. . | |
| 4,462,320 | 7/1984 | Scholl | 112/104 |
| 4,538,533 | 9/1985 | Ohchi et al. . | |
| 4,541,349 | 9/1985 | Inoue | 112/475.01 X |
| 4,582,006 | 4/1986 | Yamane . | |
| 4,586,447 | 5/1986 | Tuskos . | |
| 4,694,762 | 9/1987 | Takano et al. . | |
| 4,791,344 | 12/1988 | Yoshida et al. . | |
| 5,331,909 | 7/1994 | Tajima et al. . | |
| 5,520,129 | 5/1996 | Porter et al. | 112/470.07 |

FOREIGN PATENT DOCUMENTS

| | | |
|---|---|---|
| 1449155 | 7/1966 | France . |

OTHER PUBLICATIONS

Declaration of Michael R. Porter with Attached Exhibits, dated Jan. 15, 1998.

*Primary Examiner*—Peter Nerbun
*Attorney, Agent, or Firm*—Wolf, Greenfield & Sacks, P.C.

[57] ABSTRACT

A method and apparatus for stitching a label to material in which the material and label are joined face side down rather than face side up. The label is held face side down with a clamp and a panel is held over the label by a clamp. The label and panel are joined by a sewing machine. Further, a mechanism is provided for activating a thread knife of the sewing machine at such a time that the bobbin thread only is cut. A masking mechanism is provided for masking electronic signals of the sewing machine that would otherwise cause the machine to reset at a normal needle height, so that a sewing operation can be stopped with a needle at a maximum clearance position. Pneumatic cylinders and linkage are provided for raising the needle and presser foot at the end of a stitching operation.

19 Claims, 15 Drawing Sheets

METHOD AND APPARATUS FOR JOIN AND SEW APPLICATION

CROSS REFERENCE TO RELATED APPLICATION

This application is a continuation-in-part of U.S. application Ser. No. 08/210,584 filed Mar. 17, 1994, now U.S. Pat. No. 5,520,129 and entitled METHOD AND APPARATUS FOR JOIN AND SEW APPLICATION.

FIELD OF THE INVENTION

This invention relates generally to a method and apparatus for a join and sew application of a label to a material and, more particularly, to a method and apparatus for sewing a label to a thick, puffy, or quilted mattress panel.

BACKGROUND OF THE INVENTION

Manufacturers are particularly concerned that high quality products portray a high quality image. To this end, identifying labels are preferably made of high quality material and attached to the product in a high quality manner. In the mattress field, for example, mattress companies have specifications regarding the appearance and the attachment of the label. Among these is the requirement that the outer edge of the label must be securely sewn to a top panel of the mattress. In addition, the label should not have trim tails or other unsightly features.

To date, attaching labels to quilted mattresses has been particularly troublesome. Attempts have been made to use top-of-the-line programmable X-Y sewing machines, e.g., Mitsubishi No. PLK A 3040, to implement a commercially acceptable attachment of labels to thick, puffy, or quilted materials, such as quilted mattress panels. These machines, however, fail to provide an acceptable cost/performance ratio for the mattress construction field.

Attempts have also been made to sew labels to thick, puffy, or quilted materials, using less expensive programmable sewing machines, such as using 360° clamping machines having a bottom plate and an upper frame. Panels are placed face-side-up and then clamped down. The upper clamp includes a window to hold the label. The panel and label are then sewn together.

These attempts have proved inadequate for quilted mattress panels, in particular, because the clamping action forms an uneven surface under the label, i.e., a "concave effect." Because of the concave effect, the label cannot be held in place properly, even if an extra stage of depressing the label is used. The label gets bunched, possibly misaligned, and appears unsightly.

Two stage clamping methods and apparatus have also been attempted. The panel is placed face-side-up, and a first stage of clamping holds the quilted panel. The label is then placed, and a second stage of clamping captures the edge of the label, approximately 1/16 of an inch in from the label edge. Though the label is held relatively securely, stitching can only be performed inwardly of the second stage clamp. Consequently, the peripheral edge is not sewn down. Though these machines offer slightly more control over the label placement than the 360° clamping machines, described above, they produce a commercially unacceptable product, because the labels are unattached at the peripheral edges.

Adhesive techniques have also been attempted. The label is first glued to the mattress panel, then later stitched. These methods increase the manufacturing cost, because they involve extra handling and because the use of adhesive materials requires improved ventilation systems and the like.

Moreover, many of the methods and machines, described above, are difficult to use in the field of mattress construction because of the extra weight and thickness of the materials involved in mattress construction. Thick and puffy panels are more difficult to load and unload in a machine then are thin fabrics. Complicating this problem, standard machines do not begin operation with the needle in a position providing the maximum needle clearance. Rather, prior art machine start operation with the take up lever at top dead center. On the Mitsubishi No. PLK A 4516, for example, this position places the needle 5/16 of an inch below maximum clearance. In addition, the PLK A 4516 monitors the shaft position with an encoder, and if the shaft is rotated more than 6° from the start position, the encoder sends a reset signal to a controller of the machine.

As such, there is a need in the art for a cost effective label stitching machine that can sew labels to thick, puffy, or quilted materials, such as a quilted mattress panel, in a high quality manner.

There is also a need in the art for a label stitching method and apparatus in which the label can be sewn, without bunching, and in a reliable, high quality manner.

There is also a need in the art for a label stitching method and apparatus that sews the labels to quilted mattress panels without leaving unsightly trim tails.

There is also a need in the art for a label stitching method and apparatus in which the materials may be easily loaded and removed from the apparatus.

SUMMARY OF THE INVENTION

The present invention relates to a method and apparatus for joining a label and a thick, puffy, or quilted material, such as a quilted mattress panel, in which the material and label are joined face-side-down, not face-side-up. A label is securely held face-side-down with a clamp and tacks, for example. Then, the panel is held over the label, and the two are joined by a sewing machine. Because the label faces a flat surface and because it is securely held, the join application is less susceptible to bunching and misalignment from the concave effect.

Joining a label and material in this fashion, however, requires functionality that is not provided by the prior art. As such, the invention comprises certain modifications to a commercially available, programmable X-Y sewing machine with carriage to provide the needed functionality.

One aspect of these modifications includes having a lower clamp with tacks for securely holding the label. The lower clamp is connected to the carriage of the sewing machine.

Another aspect includes an upper clamp, connected to the carriage, for holding the quilted material over the label. The upper clamp includes mechanisms for positioning the clamp so that material may be easily loaded.

The commercially available sewing machine performs lock-stitching. Prior art lock-stitch machines cut both the bobbin thread and the needle thread at the underside of the machines at the end of the application. This results in trim tails from the dangling needle thread. Because the present invention operates on materials face-side-down, these trim tails would be commercially unacceptable, because they would appear on the face side of the label.

Thus, yet another aspect of the invention includes a mechanism for activating the thread knife of the sewing machine at a time such that the bobbin thread only is cut. This prevents the formation of needle thread trim tails on the face side of the label. This aspect further includes a cutter and nipper at a top-side of the machine to cut and grab the needle thread.

Because the present invention operates on thick materials, maximum needle clearance is desirable to facilitate the loading and unloading of the material. Consequently, another aspect of the invention relates to modifying the sewing machine to place the needle at the maximum needle clearance position.

In one feature, collar is attached to the main shaft of the sewing machine, and a mechanism is provided for engaging the collar to cause the main shaft to rotate. A stopper mechanism is provided for stopping the rotation of the shaft at the position that corresponds to the maximum needle clearance position. A masking mechanism is provided for masking the electronic signals of the sewing machine that would otherwise cause the machine to reset. In another feature a modified linkage is provided for both the presser foot and the needle. This feature includes one pneumatic cylinder for raising the presser foot and another cylinder for raising the needle an even greater distance upon completion of a stitching operation in preparation for the next stitching operation. This additional feature allows the machine to stitch even thicker materials.

The invention also relates to a method for sewing the label to the a panel, which may include the following steps: holding a label face-side-down; holding a thick, puffy, or quilted panel over the label; and joining the panel and the label with a lock-stitch of a needle thread and a bobbin thread.

The method may also include steps of cutting the bobbin thread only on the underside of the machine, and cutting the needle thread on the needle side of the machine.

The invention also relates to a method for sewing a label to a panel which may include the following steps: masking a reset signal of a stitching machine; engaging a main shaft of the stitching machine to cause the main shaft to rotate; stopping the rotation of the main staff at a position corresponding to a needle of the machine being at maximum needle height; loading the label and panel into the machine; and joining the label and panel.

BRIEF DESCRIPTION OF THE DRAWING

The invention will be more fully appreciated from the following detailed description when taken in conjunction with the accompanying drawing, in which.

DETAILED DESCRIPTION

The present invention relates to a method and apparatus for joining a label and a thick, puffy, or quilted material, such as a quilted mattress panel. The invention holds a label face-side-down on a work surface and holds the panel over the label. The panel and the label are then joined with a lock-stitch. It has been found that joining a label and panel in this fashion is less susceptible to misalignment or bunching from the concave effect. To achieve a cost effective solution, the present invention includes certain modifications, described below, to a commercially available, programmable X-Y sewing machine with carriage.

Figure 1:
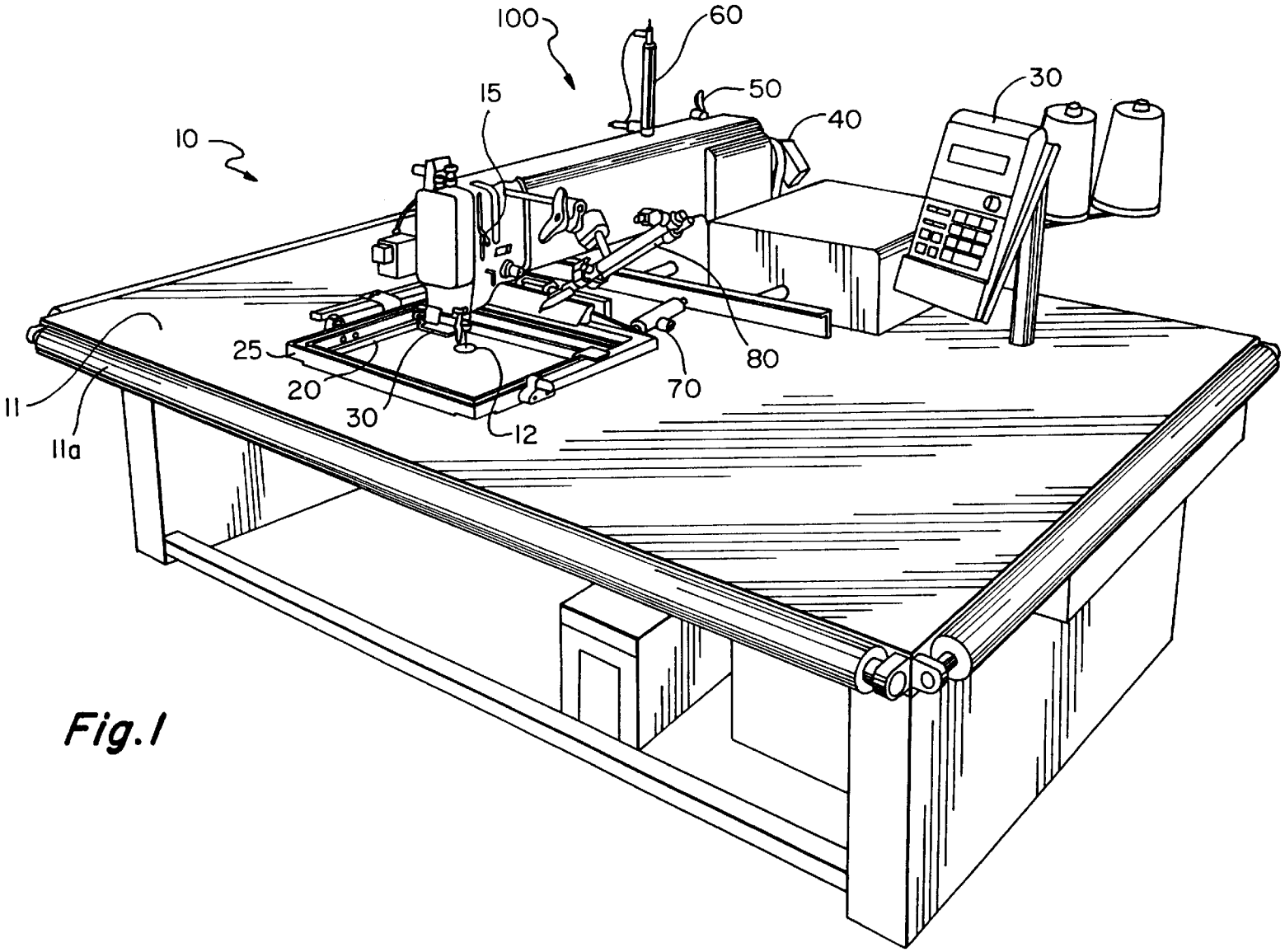
FIG. 1 is a perspective, view of a preferred embodiment of the invention.
Figure 12:
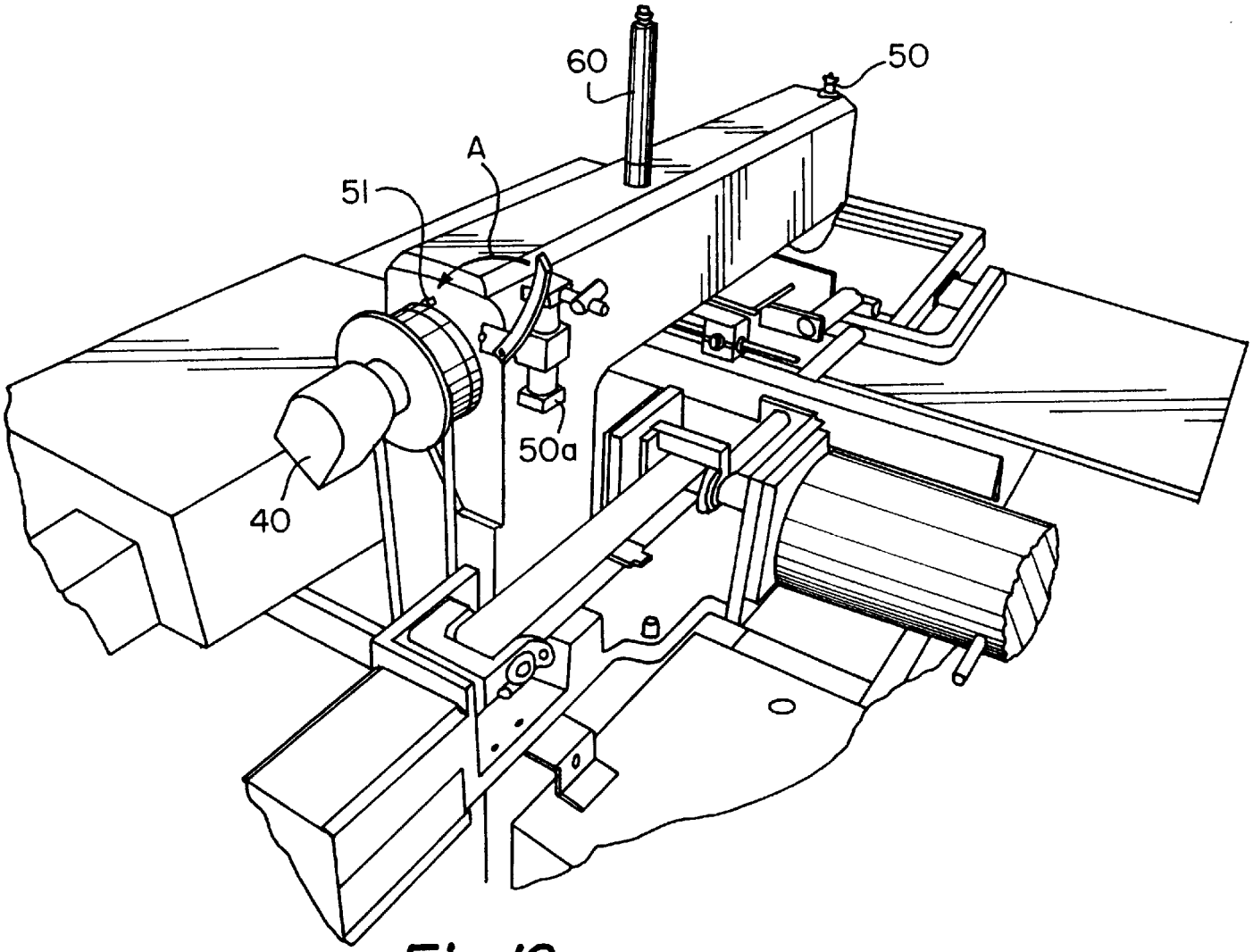
FIG. 12 is a perspective view, which illustrates a stopper attached to a hand wheel.

FIG. 1 is a perspective, top-side view of a preferred embodiment of the invention. The label stitching system is indicated generally as 10. The system includes a work surface 11, a stitcher apparatus 100, an upper clamp 25, a clamp cylinder 26 (FIG. 3), a lower clamp 20, a knife cylinder 150 (FIG. 7C), a cutter and nipper 80, a collar 200 (FIG. 13), a lever 50, a stopper 51 (FIG. 12), and a pneumatic cylinder 60. The stitcher 100 includes a controller 30, a hand wheel 40 attached to a main shaft (FIG. 12) of the stitcher, a wiper 30, a needle 13, a presser foot 12, a bobbin (not shown), and a carriage 70. Certain of these stitcher elements are modified as described below. The particular elements of the stitcher will be described in the context of the system elements.

The work surface 11 may be of several forms, but is shown as a table top having rollers 11*a* for facilitating movement of the materials.

Stitcher 100 is an electronically programmable X-Y sewing machine, with certain modifications described below. A preferred embodiment of the invention utilizes a Mitsubishi No. PLK A 4516. The stitcher 100 performs lock-stitching and may be programmed to implement different styles of lock-stitching. A preferred style uses a zig-zag stitch of 7.5 millimeters. Lock-stitching is a known technique of interlacing a needle thread and bobbin thread, which will not be described here further except to indicate that a needle thread is carried by needle 13 and a bobbin thread provided by a bobbin (not shown).

Figure 11:
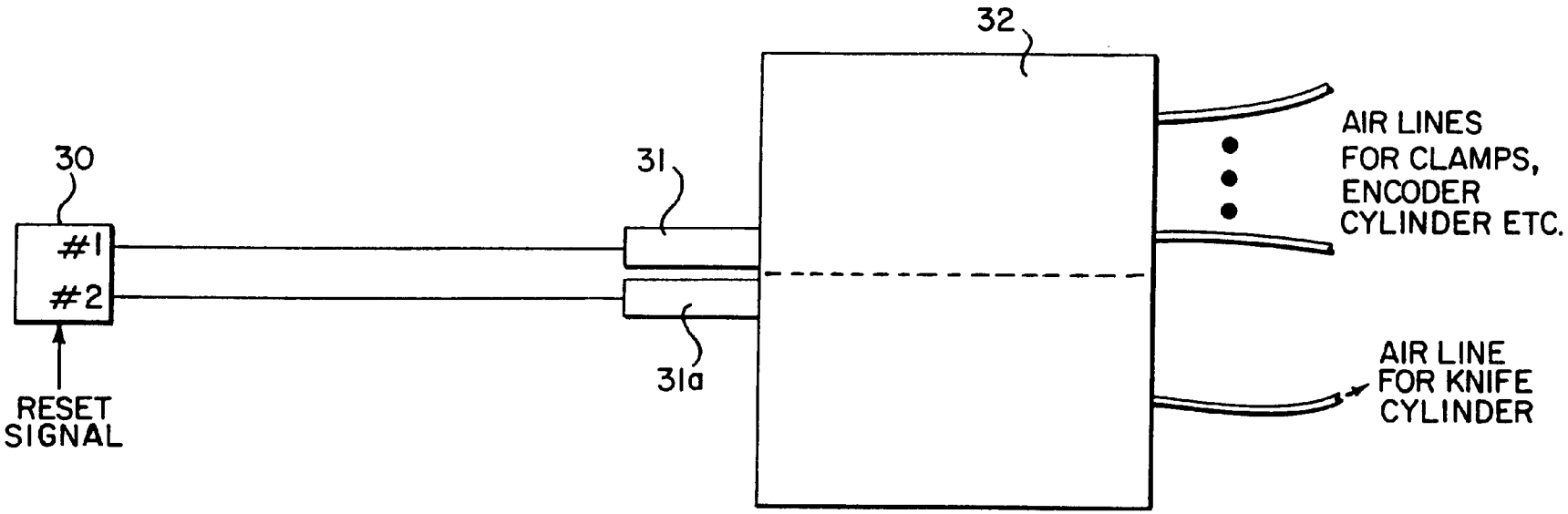
FIG. 11 is a block diagram of the control system for pneumatic components of the apparatus of FIG. 1.

Controller 30 is included as part of the underlying commercially available stitcher, i.e., the Mitsubishi No. PLK A 4516. This controller receives known inputs from the stitcher 80, e.g., the main shaft encoder, and the controller 30 provides control signals to the stitcher 80 and the carriage motor, e.g., to implement the stitch pattern. In a preferred embodiment, the control program provides signals to output ports, at known times. An output port #1 is asserted when the controller 30 is instructing the stitcher 80 to raise the presser foot 12. An output port #2 is asserted when the thread knife is to be activated. The output port control signals are received by solenoids 3 (see FIG. 11). The solenoids, in turn, activate pneumatic logic 32, which supplies the appropriate air supply to the various air lines needed by the various pneumatic components, described below, in a manner known in the art. The air lines are not shown so that the drawing is not obscured. The sequencing of the activation of the output port will be apparent from the description. The sequencing of the providing of air pressure follows therefrom. The air cylinders and other pneumatic devices are standard off-the-shelf pneumatic components available for example from manufacturers such as "Bimba."

Figure 2:
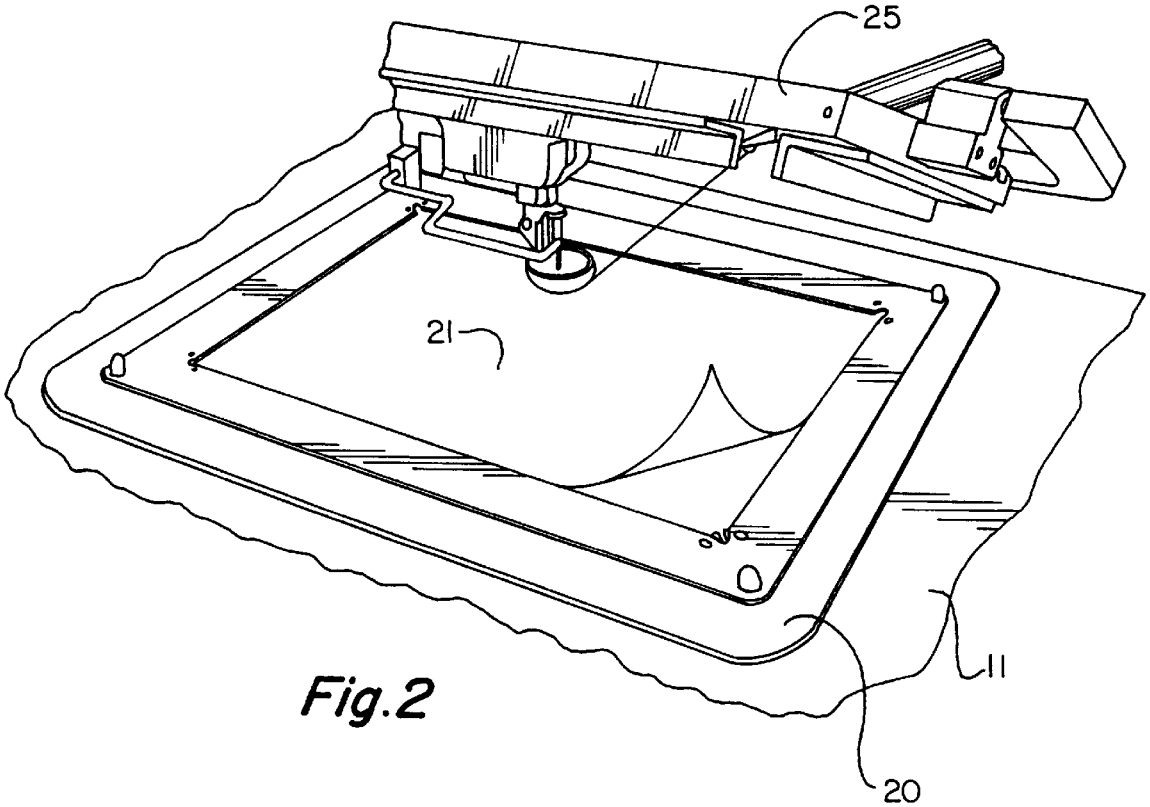
FIGS. 2 and 2A are enlarged perspective views of a lower clamp of a the apparatus of FIG. 1.
Figure 2A:
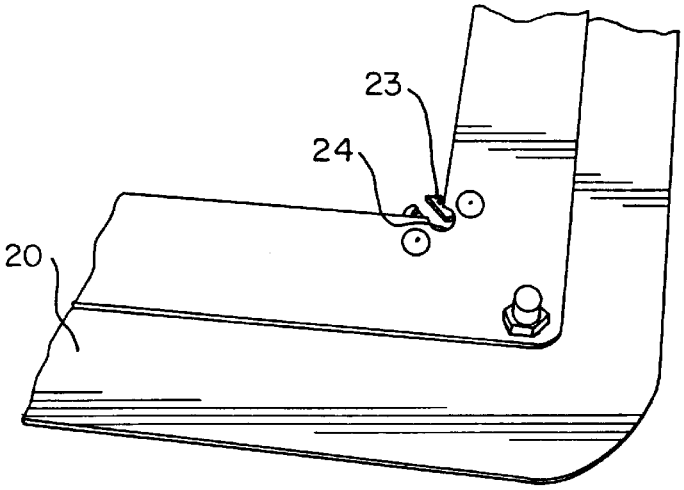

FIGS. 2 and 2A illustrate lower clamp 20. In operation, lower clamp 20 holds label 21 face-side-down over work surface 11 with tacks 23, located at each corner of the inner edge. Passages 24, located at the corners, allow a zig-zag stitch or the like to end exactly at the corners.

Figure 3:
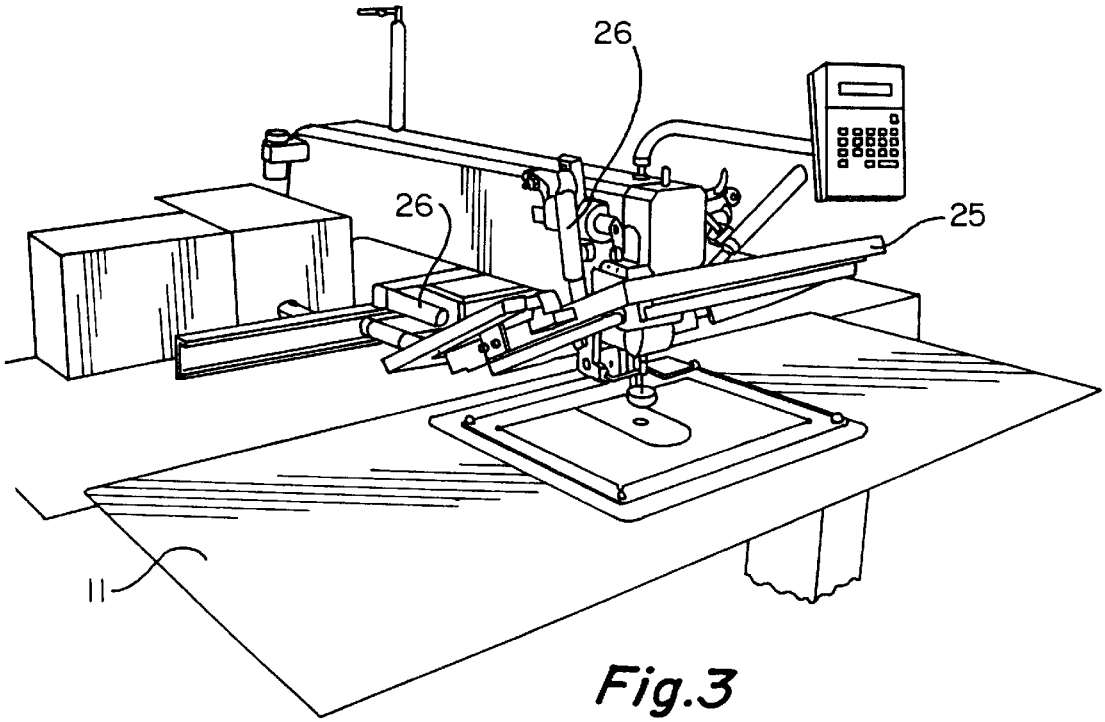
FIG. 3 is a perspective view of an upper clamp in an open position in relation to the lower clamp of FIG. 2.

FIG. 3 illustrates upper clamp 25 in an elevated and tilted position. This particular position allows easy loading of a panel. The upper clamp is raised, lowered, and tilted by pneumatic clamp cylinders 26.

Figure 4:
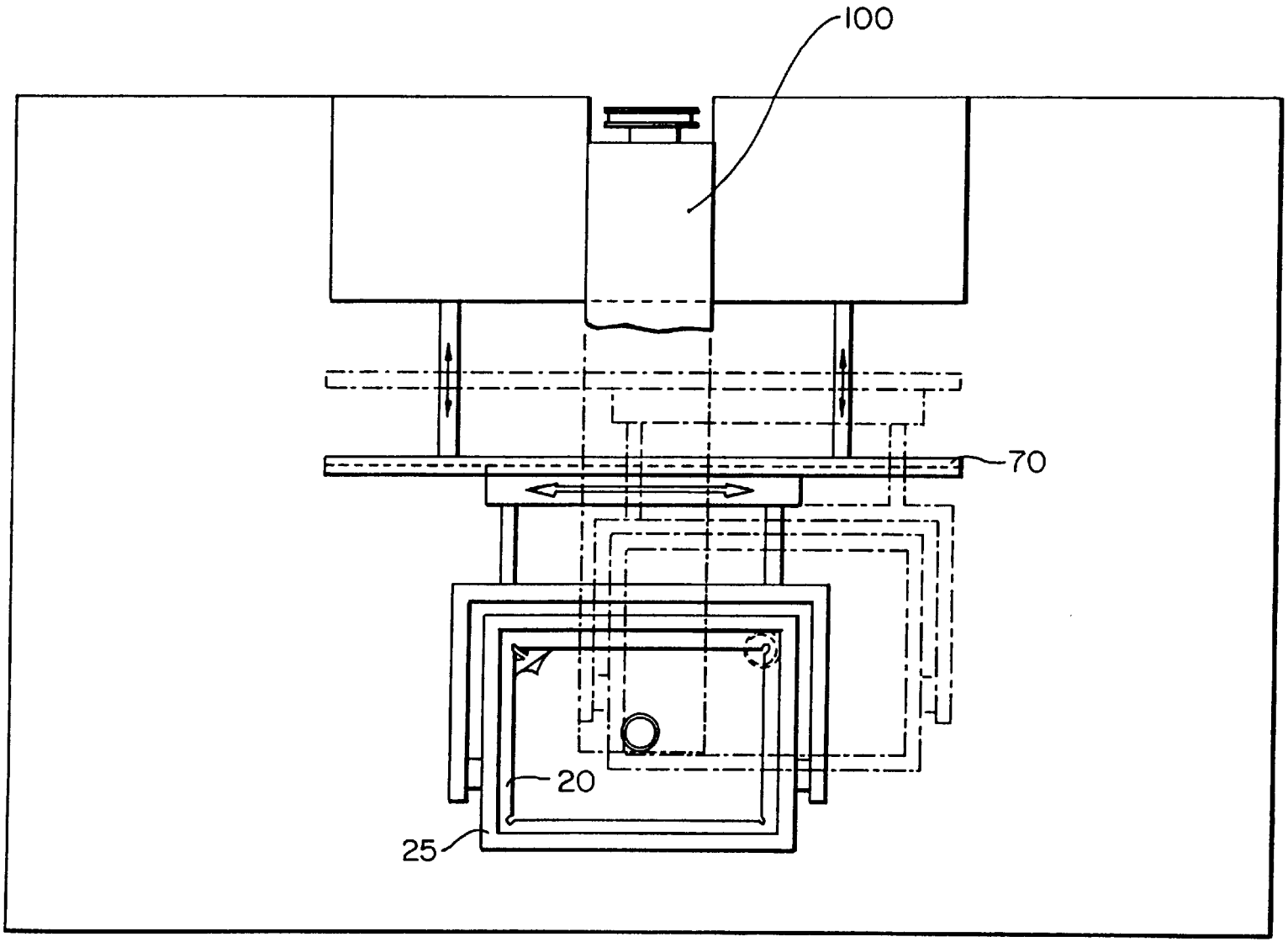
FIG. 4 is a top plan view of the apparatus of FIG. 1, illustrating planar movement of a carriage.

FIG. 4, a top view of the invention, illustrates the operation of upper clamp 25 and lower clamp 20, in relation to the planar movement of carriage 70, which operates under the control of controller 30. The controller instructs the carriage to move in a particular fashion to implement the desired stitch pattern. This movement causes the panel and the label, held by the upper and lower clamp, respectively, to be carried under the needle 13 so that they may be joined with a lock-stitch. Because the invention may be used with thick and heavy panels, e.g., quilted mattress panels, in some applications a stronger carriage motor may be necessary to provide sufficient force and torque to move the carriage 70.

Figure 6:
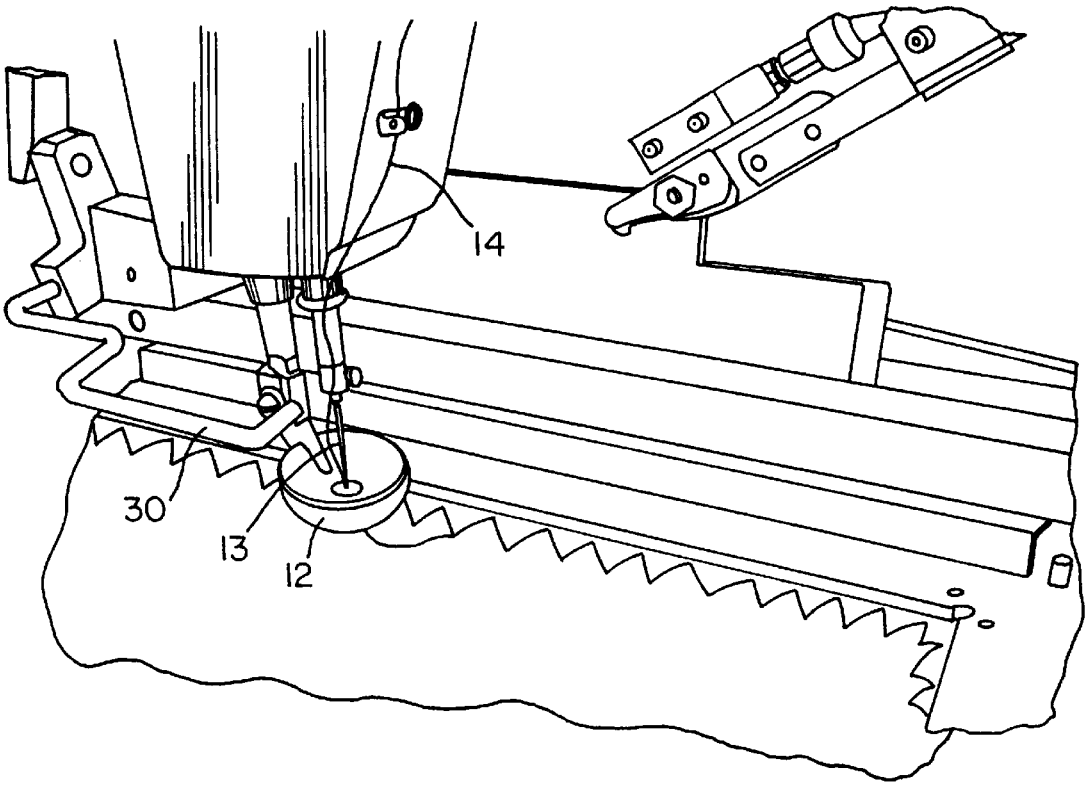
FIG. 6 is an enlarged perspective view of a presser foot, needle, and an needle thread of the apparatus of FIG. 1.

FIG. 6 illustrates an enlarged view of presser foot 12 and needle 13. Prior art presser feet typically have a foot print of ⅜ of an inch and typically provide a flat surface to face the materials. Because the present invention operates with the label face-side-down and the panel held over the label, the panel faces the presser foot. When joining a puffy or quilted panel to a label in this fashion, the presser foot remains in contact with the panel, during the stitching operation, due to the quilted nature of the panel. Accordingly, a preferred embodiment uses a modified presser foot 12 that is substantially larger than the prior art. The new presser foot 12 provides a spherical surface to face the panel and has a foot print on the order of 1.5 inches. This new design is less likely to catch and tear the materials.

Figure 7A:
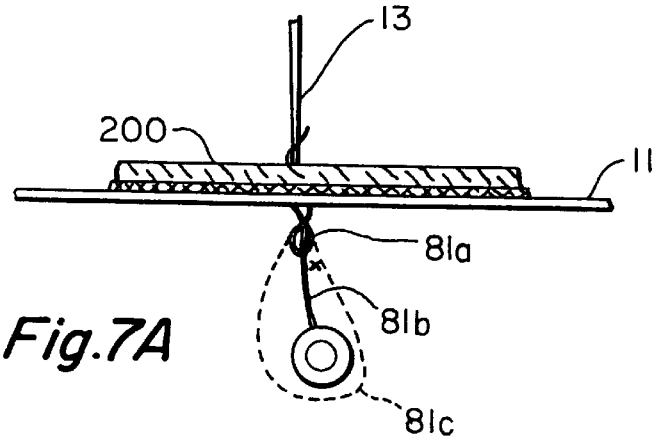
FIG. 7A illustrates prior art knife timing by showing a partial cross section of a front view of the apparatus of FIG. 1.
Figure 7B:
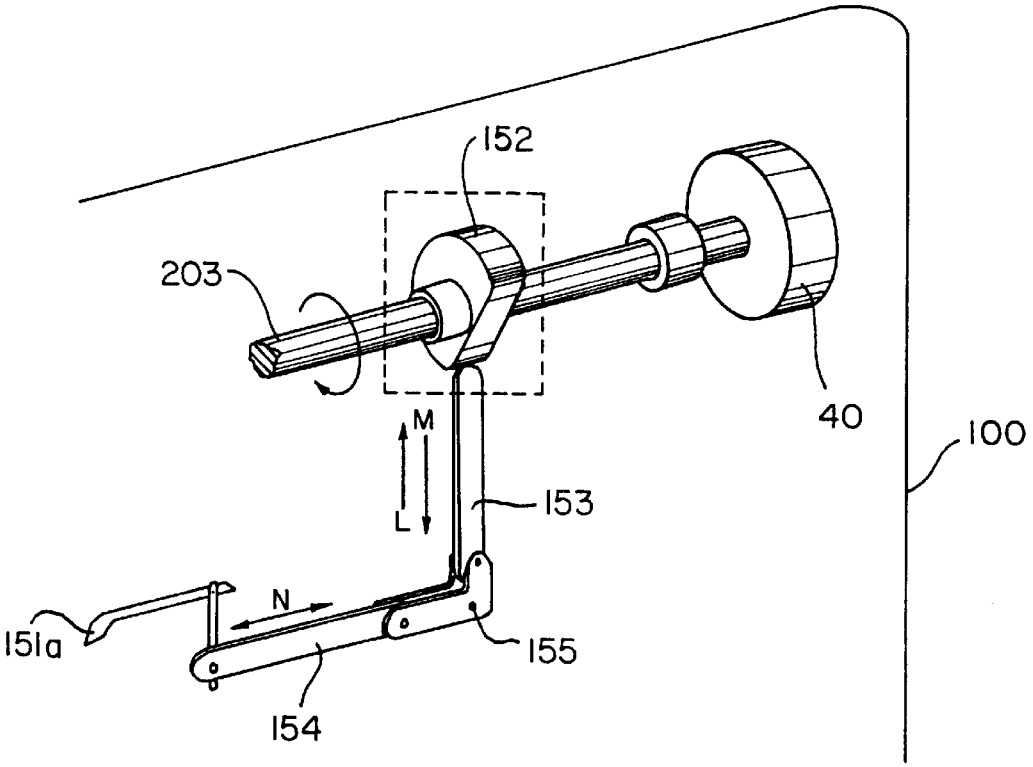
FIG. 7B illustrates prior art knife linkage.
Figure 7C:
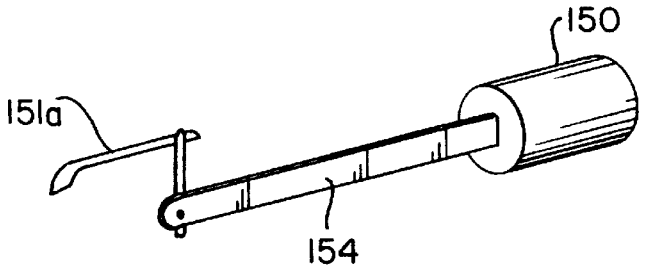
FIG. 7C illustrates the knife linkage and knife cylinder of the apparatus of FIG. 1.

Referring to FIGS. 7A–C and 14 conjointly, at the end of a lock-stitch operation, a thread knife mechanism 151 having a fixed knife 151*b* and a movable knife 151*a* of the stitcher 100 cuts thread on the underside of the machine, i.e., the bobbin side of the machine. As this knife mechanism is known, only the material features in relation to the invention are described. As is known in the art, a movable knife 151*a* catches thread on the bobbin side of the machine, causing the thread to be cut by fixed knife 151*b*. In the prior art, the timing is such that both the bobbin thread 81*b* and the needle thread 81*c* are cut (FIG. 7A). The timing and loop formation of lock-stitching are known. In addition, the prior art timing of thread cutting is known. As such they will not be repeated here.

The prior art timing, however, results in the formation of a trim tail on the bobbin side of the machine from the cut, dangling needle thread. Because the present invention joins the label face-side-down, such a trim tail would appear on the face side of the label and result in an unacceptable product.

Accordingly, the present invention modifies the timing of the thread cutting operation. The thread cutting timing of the present invention is delayed such that the needle thread 81*a* is pulled from the knife's 151*a* trajectory, before the knife is activated. In a preferred embodiment, a pneumatic knife cylinder 150 is used to implement this new knife timing. By cutting the bobbin thread only, the unsightly trim tail is avoided. FIG. 7B illustrates conventional mechanisms used to drive movable knife 151*a*.

The conventional machine uses a known thread trimmer cam 152 that is responsive to the main shaft 203 of the machine. The cam urges a cam follower 153 that is connected to a pivot point 155 which translates the vertical motion L-M of the follower 153 into a horizontal motion N. The horizontal motion then activates linkage 154 attached to the movable knife 151*a*. All of this is known. The present invention disconnects the follower 153 from the known linkage 154 at the pivot point 155 and drives the linkage 154 with the pneumatic cylinder 150 as shown in 7C. The linkage 154 is connected to the cylinder 150 with known techniques. Thus, the timing of the movable knife 151*a* is controlled by the controller 200.

To better illustrate this concept, referring to FIG. 7A, the prior art needle thread formation 81*c* is shown in shadow. Because lock-stitching is already known, the formation of the thread loops will not be described. The trajectory of the movable knife 151*a* is perpendicular to the page at point X. As seen, the novel timing of the present invention allows sufficient time for the needle thread 81*a* to be pulled by the stitcher 100 to remove the needle thread 81*a* from the knife's trajectory. Thus, it will not form a trim tail on the bobbin-side of the machine.

Figure 8:
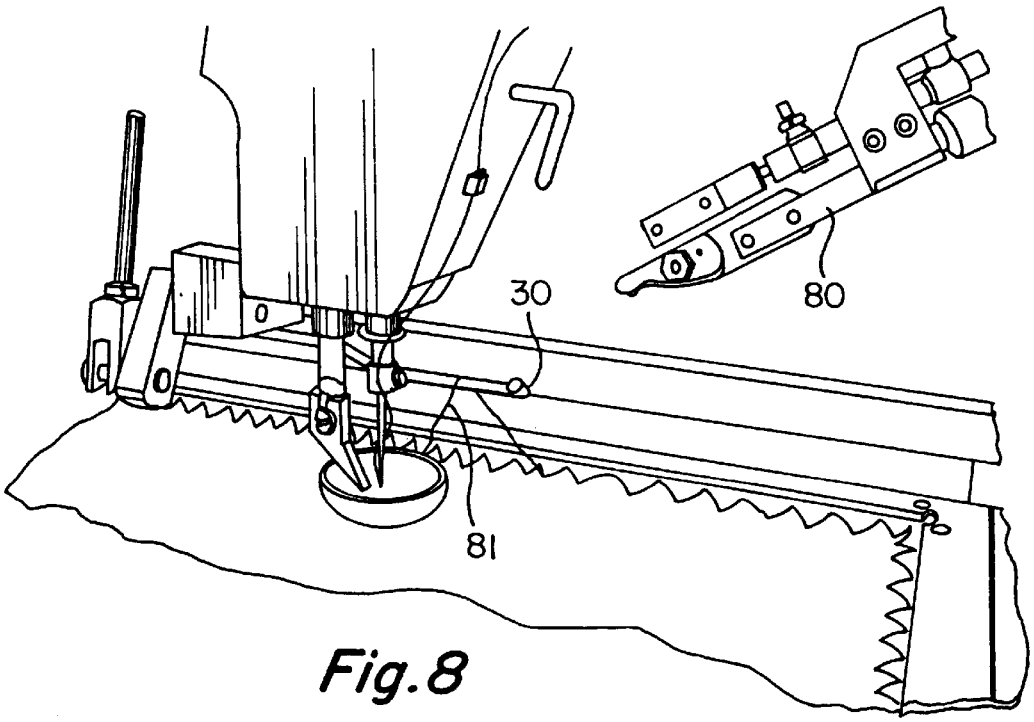
FIG. 8 is a perspective view, which illustrates a wiper in relation to a presser foot of the apparatus of FIG. 1.
Figure 9A:
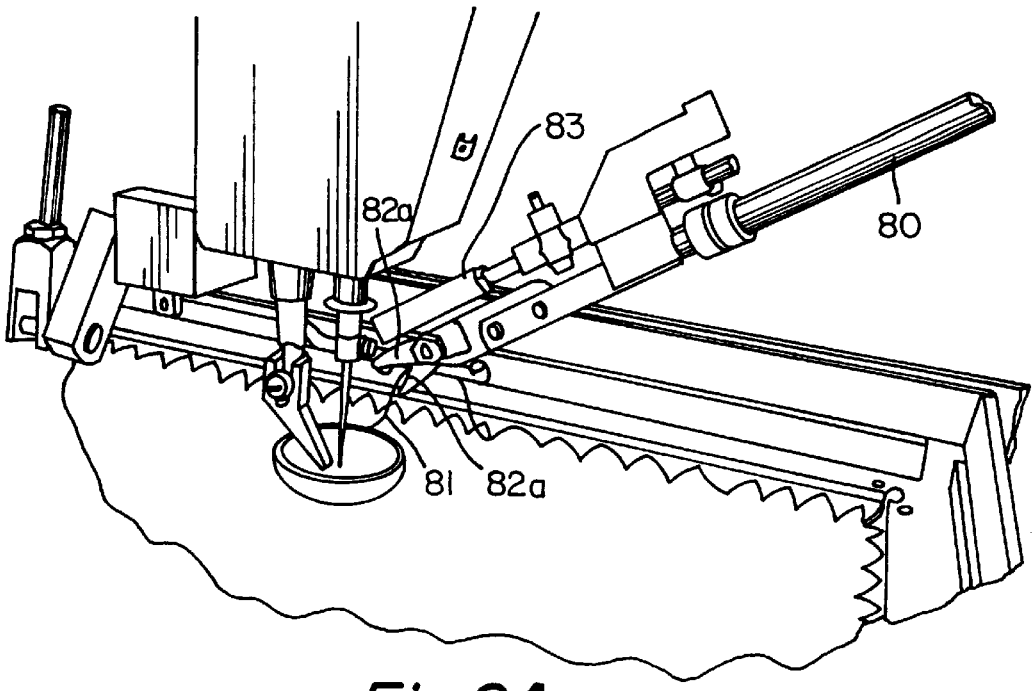
FIGS. 9A–9B are perspective views which illustrate the operation of a cutter and nipper of the apparatus of FIG. 1.
Figure 9B:
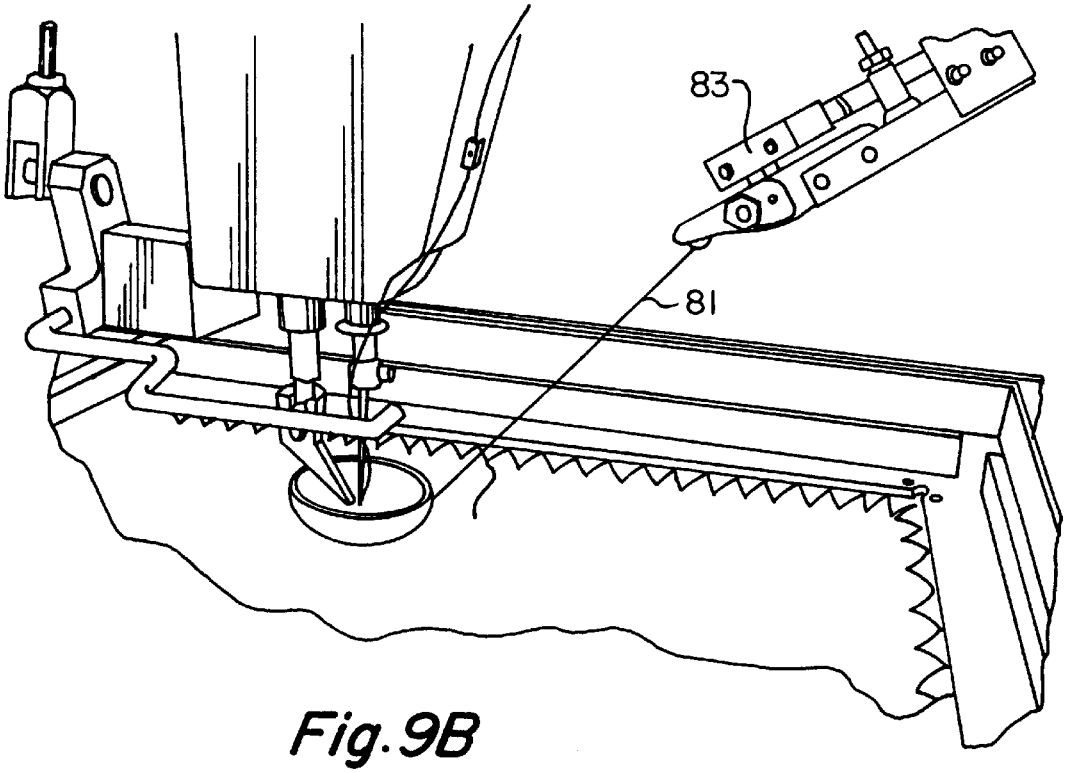

As just described, the bobbin thread 81*b* only is cut on the bobbin-side of the machine. A mechanism is thus needed to cut the yet uncut needle thread 81*a*. FIGS. 8 and 9A–9B illustrate the needle thread cutting apparatus of a preferred embodiment. Wiper 30, standard equipment with the underlying stitcher, is shown in an activated position. The wiper is activated after the clamps have been moved from the wiper's trajectory. Wiper 30 lifts the needle thread, which is still attached to a needle thread supply and creates a needle thread section 81. (In the prior art, the wiper would brush stray thread away).

A cutter and nipper 80 is provided for cutting and grabbing the thread section 81 (see FIG. 1 for positioning, in perspective view). Under pneumatic pressure, jaws 82 of cutter and nipper 80 are protracted in an open position to engage thread section 81, see FIG. 9A. The jaws 82 have jaw blades 82*a* that are capable of cutting a thread such that one portion is released, while the other portion is held. The upper blade is fixed and the lower blade is pivotable. Each blade has a shearing side and a nonshearing side. The nonshearing sides grip the thread while the shearing sides sever it. Similar blade constructions are produced by Juki, but these constructions are not pneumatically driven, as described below. Jaws 82 then close, both cutting and holding the thread. The opening and closing operation of the jaws is controlled by the pneumatic lever mechanism 83 (see FIGS. 9A and 9B for both states). After the cutting, the jaws are retracted, while still holding the needle thread.

Consequently, the needle thread is cut from the joined label and panel, and the jaws hold the thread section 81, ready for subsequent joining applications.

Because the present invention may operate on thick panels, loading and unloading panels is a concern. To this end, the upper and lower clamps are constructed for easy loading, as previously described. However, standard programmable X-Y sewings machines are typically constructed such that stitching operations are completed with the needle not positioned in the maximum needle height position. This complicates the loading process.

Accordingly, to address this problem, a second aspect of the invention includes certain modifications, described below, to position the needle at the maximum needle clearance position, without resetting the machine.

Figure 10:
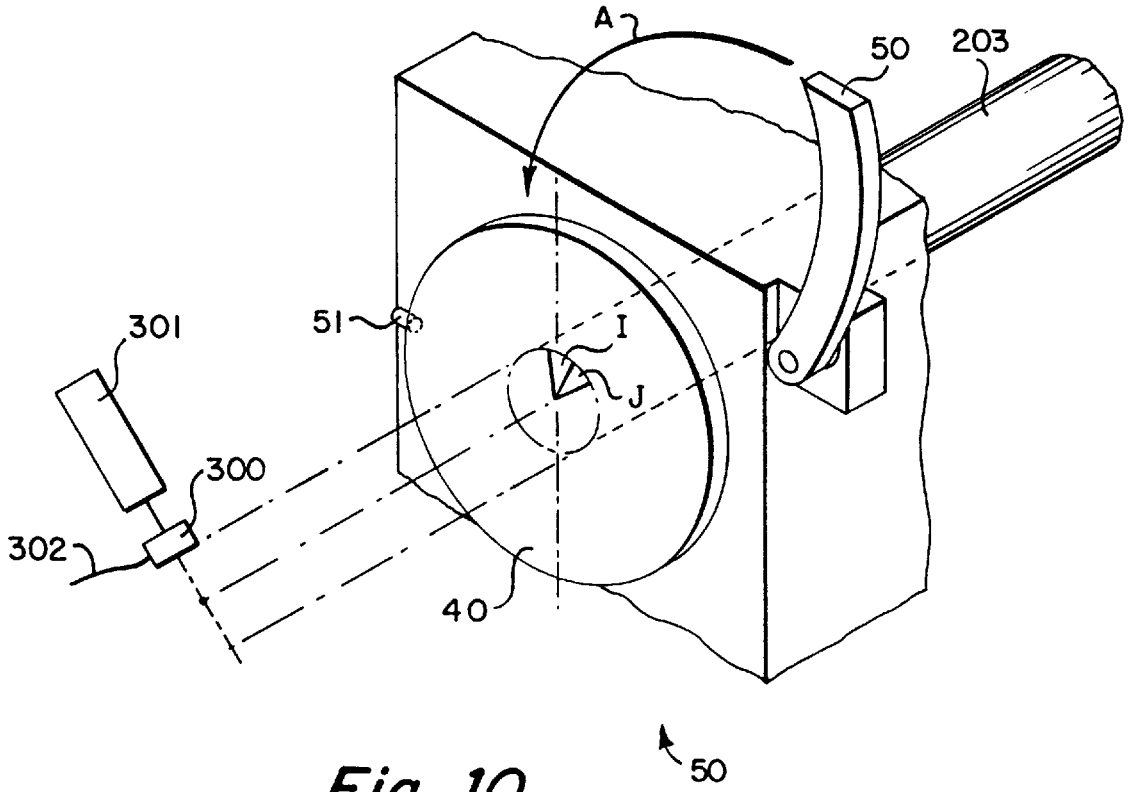
FIGS. 10–10*a* illustrates the encoder reset signal masking mechanism of the apparatus of FIG. 1.
Figure 10A:
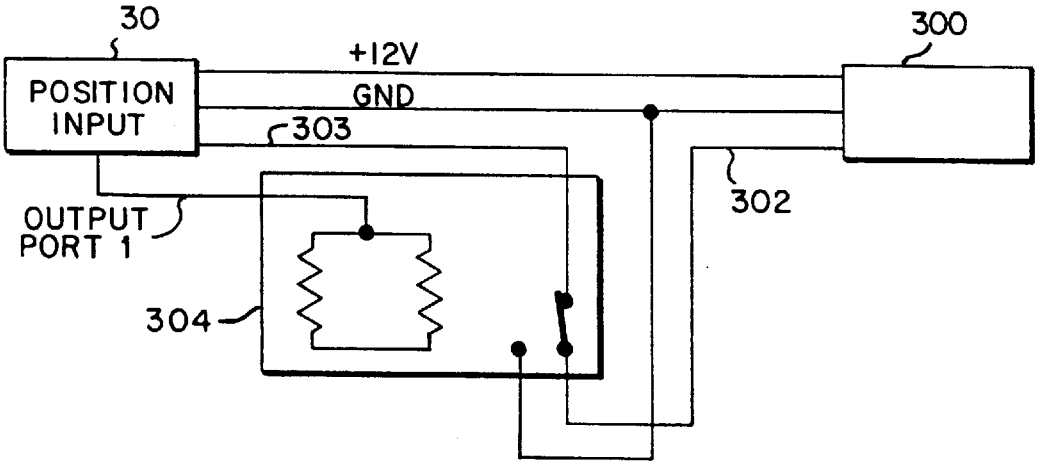

FIGS. 10 and 10*a* illustrate a preferred embodiment of masking the encoder signal that informs the controller 30 to reset the machine. This electronic masking prevents the machine from being reset, which occurs when the shaft is positioned more than 6° from the usual stop position. As described above, the usual stop position corresponds to the take up lever 15 being at top dead center. As is known in the art a conventional encoder 300 monitors a so-called "window" I on hand wheel 40. In the present invention, hand wheel 40 is repositioned, as described below. This repositioning would cause the encoder 300 to reset the controller 30 because the hand wheel 40 is not within 60 of the usual stop position. However, a masking mechanism is provided to temporarily blank out the reset signal. The encoder signal 302 is received by a relay 304, which also receives ground and output port #1. As such, when the controller instructs the presser foot to lift, i.e., when materials are to be loaded, the encoder signal is masked out to ground by the relay. That is, position input 303 of controller 30 receives ground.

At substantially the same time, the encoder 302 is physically repositioned by activation of pneumatic cylinder 301, which is connected and mounted with conventional techniques. The angle of the repositioning of the encoder 302 is such that the encoder will be positioned into alignment with position J, i.e., the position of window I after the hand wheel is rotated as described below. The hand wheel 40 is then rotated, as described below, and the relay 304 is deactivated so that the encoder may "read" the window I. Thus, the controller 30 will believe that the handwheel 40 is in the correct home position because the encoder is correctly positioned over the window. The encoder 300 will be returned to its home position so that it may count rotations and function normally. It is returned to its home position by the deactivation of cylinder 301.

To position the main shaft to place the needle at maximum clearance and to position window I in position J, lever 50 is rotated as shown with arrow A into contact with the hand wheel 40 by pneumatic rotator 50A, which is fixed to the casing of the stitcher 100. The contact is such that lever 50 may slide over the periphery of hand wheel 40, when it rotates. A stopper 51 is fixed to the hand wheel 40 at a position corresponding to the needle being at maximum height, which is when window I is at position J (see FIG. 12). For example, on the Mitsubishi No. PLK A 4516 the shaft must be rotated approximately 90°.

Figure 13:
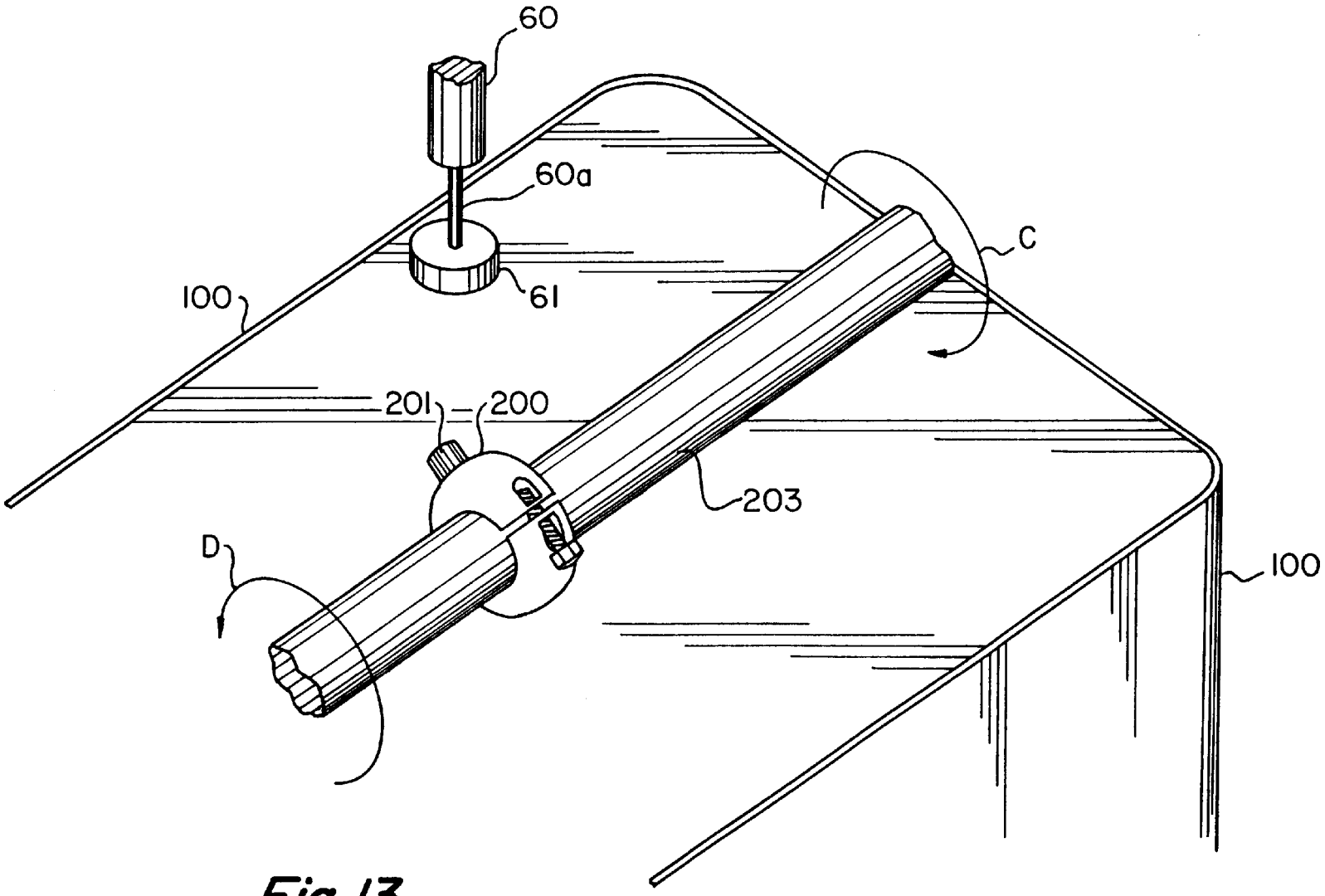
FIG. 13 is a partial cut-away view of the stitcher of the apparatus of FIG. 1.
Figure 14:
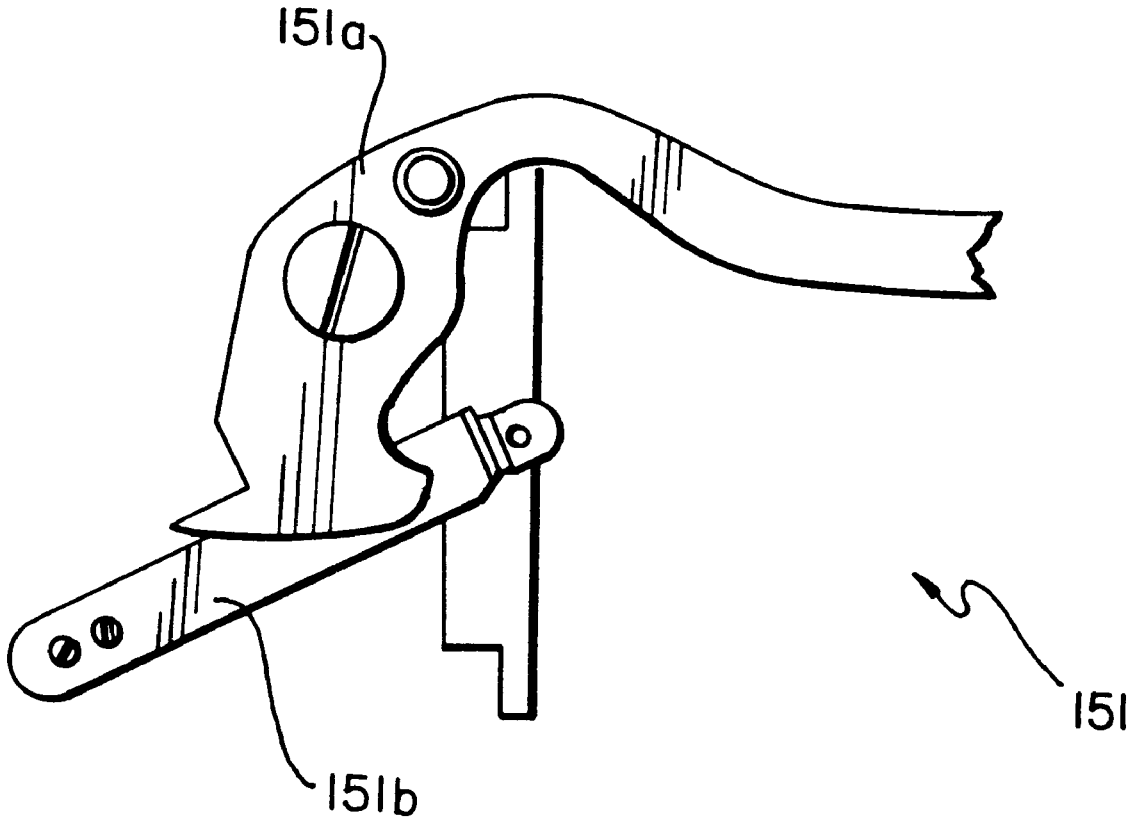
FIG. 14 illustrates the conventional thread knife mechanism of the apparatus of FIG. 1.

Referring to FIG. 13, a partial cut-away view of the stitcher 100, pneumatic cylinder 60 has a nylon striking pad 61. The cylinder is positioned externally on the stitcher 100 (see FIG. 1) such that when activated the cylinder rod 60*a* passes through the casing and causes pad 61 to strike tab 201. Tab 201 is fixed to collar 200, by brazing for example. The split collar 200 is joined around main shaft 203 by screws or the like. The main shaft normally rotates as indicated by arrow C. The cylinder pad 61 hitting the collar 200 causes the shaft to rotate as shown by arrow D. The rotation of the main shaft stops when the lever 50 hits stopper 51. Consequently, the main shaft is placed in a position corresponding to the needle being at maximum height (position J). Afterwards lever 50 is retracted away from the hand wheel 40 to allow the shaft to rotate normally once the stitching sequence is initiated. The machine will not reset because the controller is no longer looking for the reset condition.

Figure 5:
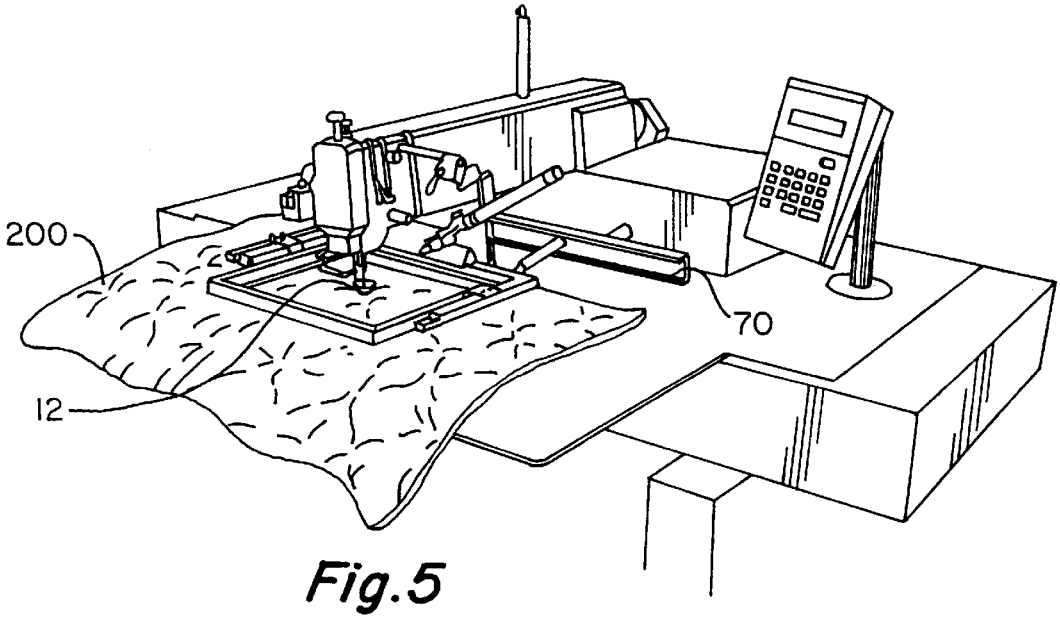
FIG. 5 is a perspective view, illustrating a panel material clamped into the apparatus of FIG. 1.

The apparatus and method for joining the label to the panel will be described with reference to FIGS. 1–14. The controller 30 is activated by a user. The controller 30 instructs the carriage 70 to move to a start position and sends an output signal to a solenoid 31, which in turn causes pneumatic logic system 32 to cause clamp cylinders 26 to tilt and elevate upper clamp 25 (see FIG. 3). A user then places a label face-side down in lower clamp 20, securing the label with tacks 23. Then, the user preferably centers a top panel, relative to the label, and places it over the label. The user again activates the controller, which causes the upper clamp 25 to lower and tilt to clamp down on the panel (see FIG. 5). The carriage is then instructed to move such that the needle and bobbin join the panel and label with a lock-stitch along an edge of the label. Preferably, they are joined with a zig-zag lock-stitch. Afterwards, the last stitch of the lock stitch continues its cycle to pull the needle thread away from the trajectory of knife 150. When the knife 150 is activated, the bobbin thread only is cut. The controller 30 then instructs the carriage to move to a position that allows wiper 30 to raise the uncut needle thread. Afterwards, a cutter and nipper 80 is pneumatically driven to cut and grab the needle thread on the needle side of the machine. The join and sew application is now complete.

When loading materials into the machine, the machine positions the main shaft so that the needle is raised to its maximum height to allow easier loading and unloading of the materials. The encoder reset signal of the sewing machine is masked. Then, a lever 50 is rotated by a pneumatic rotator, into contact with the hand wheel 40 of the sewing machine. Handwheel 40 has a stopper 51 fixed to it in a position, corresponding to the needle being at a maximum needle clearance position. After the lever 50 is rotated into contact, pneumatic cylinder 60 is driven into contact with collar 200, which is attached to the main shaft of the machine. The contact causes the main shaft to rotate, until the lever 50 contacts stopper 51. Consequently, the needle is positioned into a maximum needle clearance position.

A further aspect of the present invention will now be described with particular reference to FIGS. 15–18. In some instances, even the modifications described hereinabove with respect to FIGS. 10 and 10*a* to position the needle at the maximum needle clearance position are not sufficient to raise the needle sufficiently far prior to the stitching operation to accept very thick materials. In this aspect of the invention, to allow this apparatus to accept such thick materials, the presser foot linkage and the needle bar linkage have been modified to raise both presser foot 12 and needle 13 even farther, the only limitation being the apparatus frame.

Figure 15:
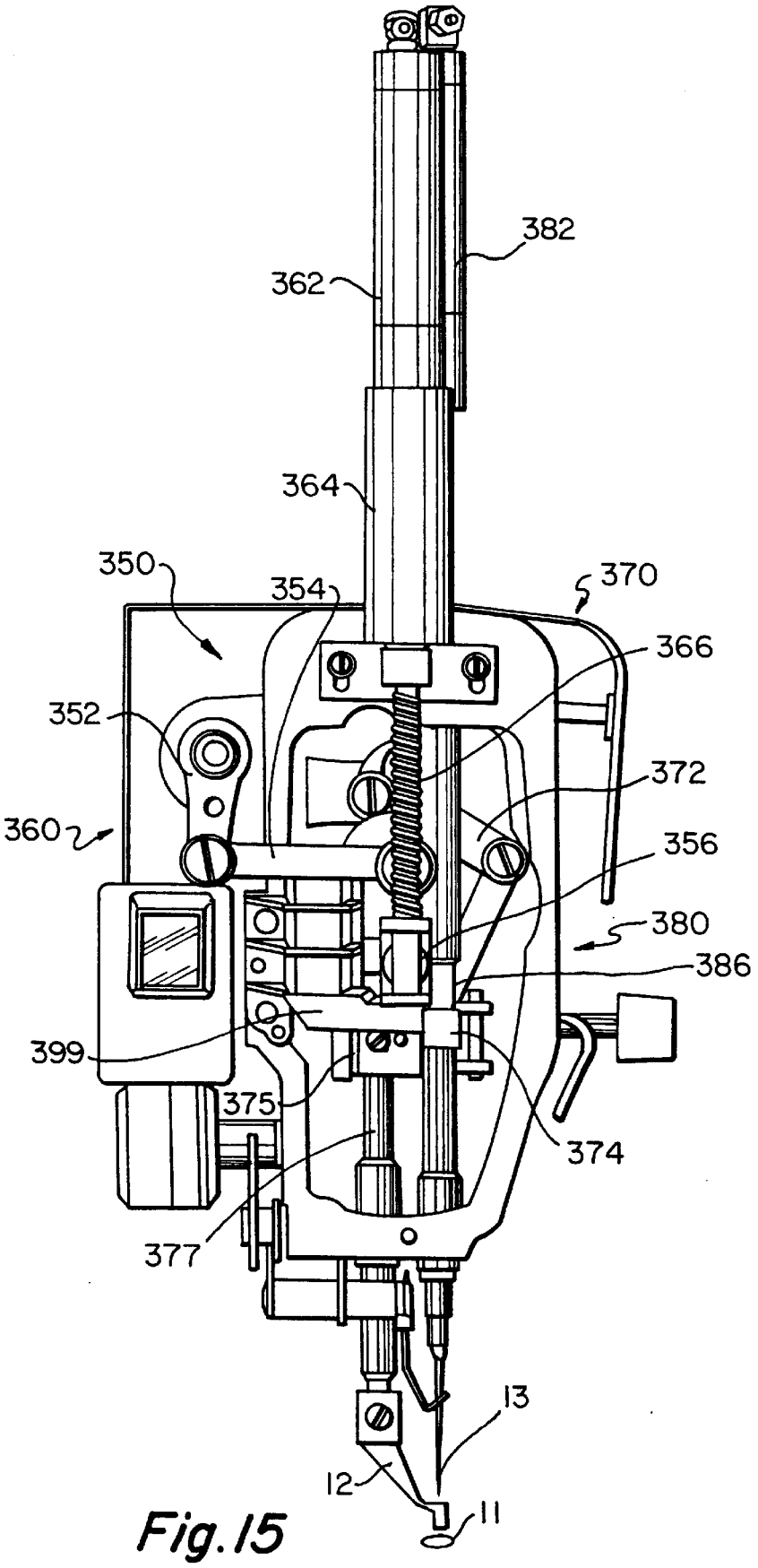
FIG. 15 is a partially cutaway, front elevation view of the sewing apparatus of this invention illustrating a modified needle bar and presser foot linkage in an extended position for sewing.
Figure 16:
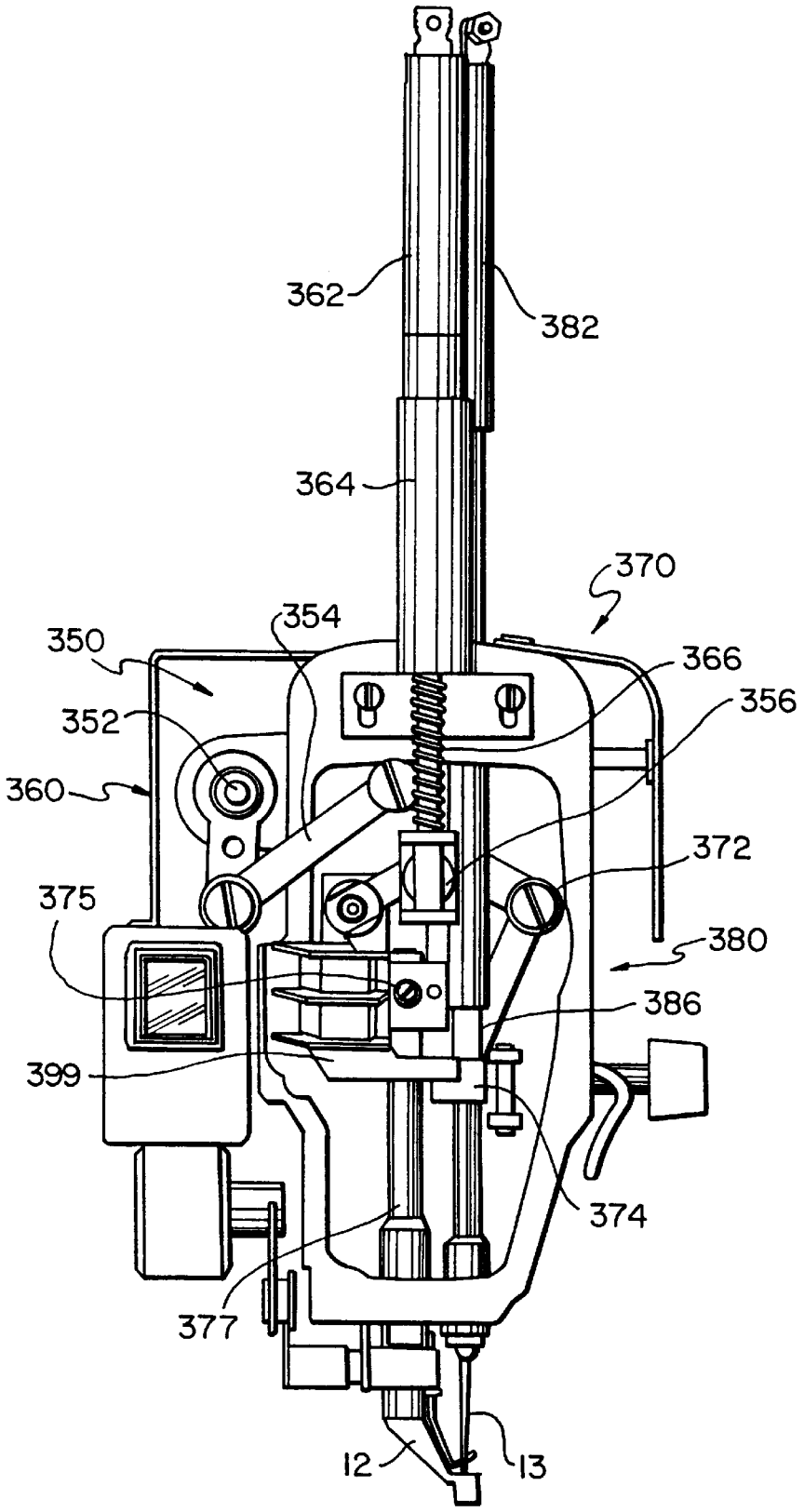
FIG. 16 is a partially cutaway, front elevation view of the sewing apparatus of FIG. 15 in which the needle and presser foot are in a retracted position.

FIG. 15 illustrates the modified presser foot assembly 360 and needle bar assembly 380 of this apparatus in a lowered position. The apparatus 350 used to oscillate presser foot 12 with needle 13 in a vertical direction is conventional, and includes rocker arm 352 and linkage 354 which is connected to presser foot assembly 360. Similarly, apparatus 370 used to oscillate needle 13 in a vertical direction is conventional and includes a linkage 372 which is coupled to needle bar assembly 380 by coupling 374. Linkage 372 is connected directly to the main drive shaft of apparatus 100 (not shown) in a conventional manner and linkage 372 also drives the thread take-up (not shown).

Figure 17:
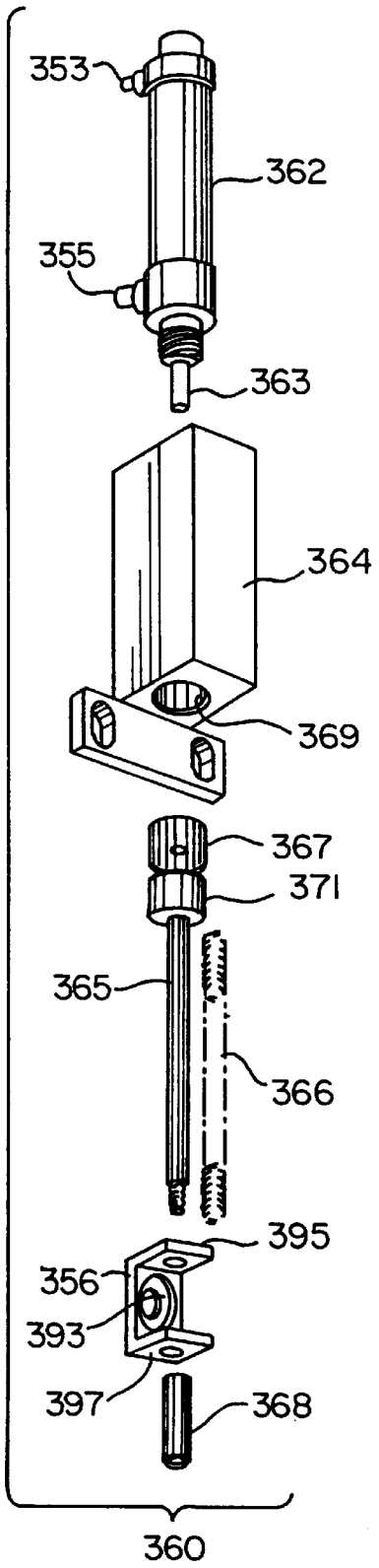
FIG. 17 is an exploded view of the presser foot linkage of the apparatus of FIG. 15.

The presser foot assembly 360 will now be described with particular reference to FIG. 17. Presser foot assembly 360 includes a pneumatic cylinder 362, shaft 363 extending from cylinder 362, mounting block 364, shaft 365, compression spring 366, coupling 367, coupling 356, collar 371 and shaft 368. Mounting block 364 and cylinder 362 are mounted in a stationary fashion to the frame of stitcher apparatus 100. Cylinder 362 includes ports 353 and 355 coupled to a source of compressed air. Cylinder 362 is threadably coupled at its lower end to block 364. Shaft 363 is permitted to oscillate in an up and down direction (as seen in FIG. 17) within a central tunnel 369 of block 364. Shaft 365 is pivotally coupled to shaft 363 by means of coupling 367 and collar 371, also oscillates in an up and down direction. Collar 371 is pivotally coupled to coupling 367 to accommodate imperfections in the linkage. Spring 366 is captured between collar 371 and coupling 356. Shaft 368 is connected to block 375 (FIG. 15) which is coupled by shaft 377 to presser foot 12.

Coupling 356 preferably has a generally U-shape, and shaft 365 is permitted to ride downwardly through holes in coupling 356. Spring 366 bears against upper surface 395 of coupling 356, while shaft 368 is disposed below a lower surface 397 of coupling 356. Shaft 368 is larger than the holes in coupling 356, so that if shaft 368 rides upwardly, it pushes coupling 356 upwardly as well. Lower surface 397 is limited in its downward movement by stop 399 (FIG. 15). Linkage 354 is coupled to presser foot assembly 360 at a point below coupling 356 in a known manner to produce the desired oscillation. Coupling 356 is also coupled directly to presser foot 12 along back wall 393, so that if a thick piece of material is introduced below presser foot 12, an upward force is applied to coupling 356 which compresses spring 366 and which permits accommodation of these thicker materials without disturbing the normal oscillatory motion of presser foot 12.

When it is desired to perform a stitching operation, air is introduced through port 353 and exhausted from port 355 of cylinder 362 to drive shaft 363 in a downwardly direction, to drive presser foot 12 to its lowered position, as shown in FIG. 15. Presser foot 12 oscillates with an up and down motion (as seen in FIGS. 15 and 17) in response to rocker arm 352 and linkage 354. When a stitching operation has been completed, air is exhausted from port 353 and introduced into port 355 of cylinder 362 to lift shaft 363 which also raises coupling 367, collar 371, shaft 365, coupling 356, shaft 368 and presser foot 12 to the position shown in FIG. 16.

Figure 18:
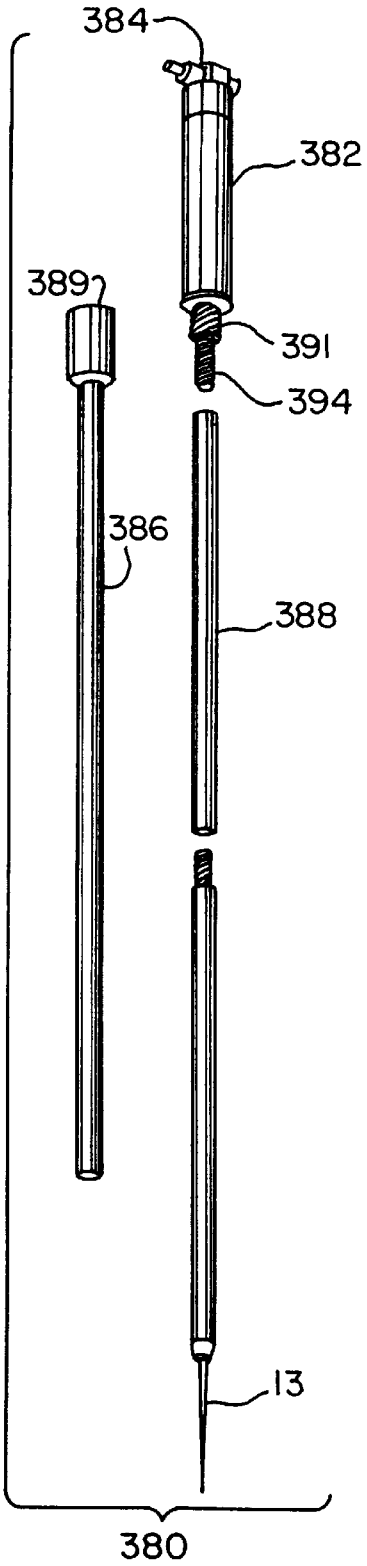
FIG. 18 is an exploded view of the needle bar linkage of the apparatus of FIG. 15.

Needle bar assembly 380 will now be described with particular reference to FIG. 18. Needle bar assembly 380 includes pneumatic cylinder 382 having a port 384, sleeve 386, and shaft 388. Shaft 388 may comprise multiple shafts linked together, or a single shaft. Disposed at the end of shafts 388 is needle 13. Sleeve 386 is threadably coupled at an enlarged end 389 to threads 391 on cylinder 382. Shaft 388 is coupled to cylinder shaft 394 which rides up and down within cylinder 382. Cylinder 382 rides up and down with needle 13.

When it is desired to perform a stitching operation, air is introduced from an external source to cylinder 382 through port 384. The introduction of air drives shaft 394 and thus shaft 388 downwardly, so that needle 13 is in the position shown in FIG. 15. When the stitching operation has been completed, gas is exhausted from cylinder 382 through port 384 causing shaft 384 and thus shaft 388 to rise with respect to sleeve 386, lifting needle 13 to the position shown in FIG. 16. During the stitching operation, linkage 372 is coupled at coupling 374 (FIG. 15) to sleeve 386 to produce the desired oscillating motion. Cylinder 382 rides up and down with sleeve 386 which also causes shaft 388 and needle 13 to ride up and down in the desired stitching manner.

In view of the above description, it is likely that modifications and improvements will occur to those skilled in the art, which should be deemed as being within the scope of this invention. The above description is intended to be exemplary only, the scope of the invention being defined by the following claims and their equivalents.

We claim:

1. A label stitching machine comprising:

a base having a top surface;

a carriage disposed adjacent the top surface and being movable along the top surface;

a lower clamp attached to the carriage for clamping a first material;

an upper clamp attached to the carriage for clamping a second material over the first material;

a sewing machine including stitching means for stitching together the first and the second materials with a bobbin thread and a needle thread, the stitching means including a knife for cutting thread;

an actuator for actuating the knife to cut thread in response to a knife control signal;

a controller for controlling the sewing machine and the carriage and for providing the knife control signal at a time such that the knife cuts the bobbin thread only; and a cutter and nipper for grabbing a section of the needle thread on an upper side relative to the top surface.

2. The machine according to claim 1 wherein the upper clamp lifts away from the top surface and tilts relative to the top surface in response to a second control signal from the controller.

3. The machine according to claim 1 wherein the carriage positions the upper and lower clamps to an initial position in response to a third control signal from the controller, the initial position being defined by a needle of the stitching means being substantially centered with respect to the upper clamp.

4. The machine according to claim 1 further comprising a wiper that lifts a needle thread section away from the top surface in response to a fifth control signal from the controller, the cutter and nipper comprising a projectable head that cuts and grabs the thread section in response to a sixth control signal from the controller.

5. The machine according to claim 4 wherein the carriage moves the upper and lower clamp in a plane in response to a seventh control signal from the controller which is timed prior to the fifth control signal and prior to the sixth control signal.

6. A label stitching machine comprising:

a base having a top surface;

a carriage disposed adjacent the top surface and being movable along the top surface;

a lower clamp attached to the carriage for clamping a first material, the lower clamp including tacks located at corners of an inner edge of the lower clamp for holding the first material;

an upper clamp attached to the carriage for clamping a second material over the first material;

a sewing machine including stitching means for stitching together the first and the second materials with a bobbin thread and a needle thread, the stitching means including a knife for cutting thread;

an actuator for actuating the knife to cut thread in response to a knife control signal; and a controller for controlling the sewing machine and the carriage and for providing the knife control signal at a time such that the knife cuts the bobbin thread only.

7. A label stitching machine comprising:

a base having a top surface;

a carriage movable along the top surface;

a lower clamp attached to the carriage for clamping a first material;

an upper clamp attached to the carriage for clamping a second material over the first material;

a sewing machine including a main shaft, a stitching means for stitching together the first and the second materials with bobbin thread and a needle thread carried by a needle;

a collar attached to the main shaft;

an actuator for engaging the collar in response to a first control signal to cause the main shaft to rotate;

a stop for stopping rotation of the main shaft at a predetermined position in response to a second control signal; and a controller for controlling the sewing machine and the carriage and for providing the first and second control signals.

8. The machine according to claim 7 wherein the predetermined position corresponds to a maximum needle height position of the sewing machine.

9. A label stitching machine for stitching a label to a panel such that a face side of the label is exposed after stitching of a back side of the label to the panel, said machine comprising:

a base having a top surface;

means for holding the label in a position such that the label face side rests on the top surface of the base;

means for holding a panel adjacent the back side of the label;

a stitcher for joining the label and the panel with a needle thread and a bobbin thread;

means for cutting only the bobbin thread on the face side of the label; and means for cutting and holding the needle thread on the back side of the label.

10. A sewing machine assembly comprising:

a base having a top surface;

a carriage disposed adjacent the top surface and being moveable along the top surface;

a lower clamp attached to the carriage for clamping a first material, the lower clamp being formed of intersecting members forming corners, the members each having an inner edge facing a center of the lower clamp;

an upper clamp attached to the carriage for clamping a second material over the first material;

a sewing machine including a stitching needle for stitching together the first and the second materials;

two spaced tacks disposed at at least one corner of the lower clamp and extending inwardly from the inner edges of the intersecting members of the lower clamp forming the corner toward the center of the clamp for holding the first material against the top surface of the base; and a passage disposed between the two spaced tacks at the corner of the lower clamp and extending outwardly away from the inner edges of the members of the lower clamp forming the corner.

11. A sewing machine assembly comprising:

a base having a top surface; and a sewing machine including a sewing machine drive and a stitching needle assembly for sewing materials disposed on the top surface, the stitching needle assembly comprising:

a sewing needle;

linkage coupling the sewing needle to the sewing machine drive for moving the sewing needle up and down in a vertical direction to provide a desired stitching pattern; and a pneumatic cylinder unconnected to the sewing machine drive for raising and lowering the sewing needle in the vertical direction with respect to the top surface of the base independently of the sewing machine drive.

12. A sewing machine assembly comprising:

a base having a top surface;

a sewing machine including a sewing machine drive and a stitching needle assembly for sewing materials disposed on the top surface, the stitching needle assembly comprising:

a sewing needle;

linkage coupling the sewing needle to the sewing machine drive for moving the sewing needle up and down in a vertical direction to provide a desired stitching pattern; and apparatus for raising and lowering the sewing needle in the vertical direction with respect to the top surface of the base independently of the sewing machine drive, the apparatus for raising and lowering the sewing needle comprising:

an elongated sleeve operatively coupled to the linkage;

a shaft slidably disposed within the sleeve, the sewing needle being mounted to the shaft; and an actuator for moving the shaft with respect to the sleeve in a direction parallel to a direction of elongation of the sleeve.

13. The sewing machine assembly as recited in claim 12 wherein the actuator is a pneumatic cylinder.

14. A sewing machine assembly comprising:

a base having a top surface; and a sewing machine including a sewing machine drive and a stitching needle assembly for sewing materials disposed on the top surface, the stitching needle assembly comprising:

a sewing needle;

a presser foot;

linkage coupling the presser foot to the sewing machine drive for producing a desired motion of the presser foot;

apparatus for raising and lowering the presser foot in the vertical direction with respect to the top surface of the base independently of the sewing machine drive;

linkage coupling the sewing needle to the sewing machine drive for moving the sewing needle up and down in a vertical direction to provide a desired stitching pattern; and apparatus unconnected to the sewing machine drive for raising and lowering the sewing needle in the vertical direction with respect to the top surface of the base independently of the sewing machine drive and independently of the presser foot.

15. The sewing machine assembly as recited in claim 14 wherein the apparatus for raising and lowering the presser foot comprises:

a shaft coupled to the presser foot; and an actuator for raising and lowering the shaft with respect to the base.

16. The sewing machine assembly as recited in claim 15 wherein the actuator comprises a pneumatic cylinder.

17. The sewing machine assembly as recited in claim 14 further comprising apparatus for urging the presser foot downwardly toward the base and for allowing the presser foot to be raised upwardly away from the base independently of the sewing machine drive in response to introduction of materials between the top surface of the base and the presser foot that have a thickness greater than a predetermined distance between the top surface of the base and the presser foot.

18. The sewing machine assembly as recited in claim 17 wherein the urging apparatus comprises a compression spring.

19. The sewing machine assembly as recited in claim 11 wherein said sewing machine drive includes a main shaft, wherein said linkage couples the sewing needle to said main shaft and wherein said apparatus for raising and lowering the sewing needle is unconnected to said main shaft.

* * * * *